US007968796B2

(12) United States Patent
Chang et al.

(10) Patent No.: US 7,968,796 B2
(45) Date of Patent: Jun. 28, 2011

(54) FLEXIBLE SIGNAL TRANSMISSION MODULE AND MANUFACTURING METHOD THEREOF

(75) Inventors: Wei-Chih Chang, Hsin-Chu (TW); Hsiu-Mei Fang, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 115 days.

(21) Appl. No.: 12/430,296

(22) Filed: Apr. 27, 2009

(65) Prior Publication Data

US 2009/0314516 A1 Dec. 24, 2009

(30) Foreign Application Priority Data

Jun. 20, 2008 (TW) ..... 97123150 A

(51) Int. Cl.
*H01B 7/08* (2006.01)

(52) U.S. Cl. ..... 174/117 F; 174/117 FF

(58) Field of Classification Search ..... 174/117 F, 174/117 FF

See application file for complete search history.

(56) References Cited

U.S. PATENT DOCUMENTS 3,878,341 A * 4/1975 Balde ..... 307/113
4,898,544 A * 2/1990 Callahan ..... 439/498
6,556,117 B1 * 4/2003 Nakao et al. ..... 336/105
6,702,607 B2 * 3/2004 Kondo ..... 439/498
7,267,552 B2 9/2007 Lin et al.

OTHER PUBLICATIONS

English language translation of abstract of TW M248053.
English language translation of abstract of TW 00496115.

* cited by examiner

*Primary Examiner* — Chau N Nguyen
(74) *Attorney, Agent, or Firm* — Thomas, Kayden, Horstemeyer & Risley, LLP

(57) ABSTRACT

A flexible signal transmission module and a manufacturing method thereof are provided. The flexible signal transmission module includes a first connector, a first transmission strip, and a second transmission strip. The first and second transmission strips are respectively connected to the first connector and disposed side by side. The ends of the first and second transmission strips which connect to the first connector respectively have a first end folding line. The first and second transmission strips respectively folded along the first end folding lines toward a same direction while the folding portions of both strips partially overlap. The manufacturing method includes the following steps: disposing a plurality of transmission strips side by side; connecting the transmission strips to a first connector; and respectively folding the transmission strips along the first end folding lines toward a same direction.

17 Claims, 15 Drawing Sheets

FLEXIBLE SIGNAL TRANSMISSION MODULE AND MANUFACTURING METHOD THEREOF

This application claims priority based on a Taiwanese Patent Application No. 097123150, filed on Jun. 20, 2008, the disclosure of which is incorporated herein by reference in its entirety.

BACKGROUND OF THE INVENTION

1. Field of the Invention

The present invention relates to a flexible signal transmission module for transferring signals in electronic devices and a manufacturing method thereof.

2. Description of the Related Art

The electronic devices on the market such as televisions, computers, mobile phones, or other electronic products are composed of various circuits, modules, or electronic components. The components are responsible for receiving, processing, or transmitting electronic signals so as to accomplish the complete functions of electronic devices. Generally, signal transmission cables, flexible circuit boards, or other similar devices are disposed among various circuits, modules, or electronic components, so as to transmit signals among them and to achieve system communication.

FIG. 1 is a conventional signal cable, which includes connectors 10 at two ends and a cable 30 inbetween. The connectors 10 respectively connect to a corresponding connector on circuit boards or corresponding connectors of other modules or electronic components, while the cable 30 is responsible for the signal transmission between the connectors 10. Because the amount of terminals of the connector 10 has increased to accommodate design needs and numerous kinds of signals, the amount of corresponding strips of the cable 30 is increased accordingly. Therefore, the width of the cable 30 is also increased.

However, the appearance design of nowadays electronic devices almost focuses on space-saving and small-size, hence how to reduce the size of interior circuit modules and how to achieve the best space usability become essential issues in design. The signal cable of FIG. 1 is generally too wide to get through some smaller spaces of a housing such as the pivot between the back cover and the body of a clamshell phone, which is disadvantageous in assembling. Moreover, because the width of the cable 30 is much larger than its thickness, it can merely be bent in specific directions and then increased difficulties in arranging the signal cables.

SUMMARY OF THE INVENTION

It is an objective of the present invention to provide a flexible signal transmission module and a manufacturing method thereof, which has the advantage of easy disposition and easy accommodation in system space.

It is another objective of the present invention to provide a flexible signal transmission module and a manufacturing method thereof, which increase varieties of system space design.

It is yet another objective of the present invention to provide a flexible signal transmission module and a manufacturing method thereof, which reduces the entire system volume and the space requirement.

In one embodiment, a flexible signal transmission module includes a first connector, a first transmission strip, and a second transmission strip. The first and the second transmission strips each has an elongated shape. The two transmission strips are disposed side by side and respectively have an end connected to the first connector. The ends of the first and the second transmission strips which connect to the first connector respectively have a first end folding line. The first end folding line is merely an imaginary baseline for the first transmission strip or the second transmission strip to be folded, hence a concrete line is not necessary. The first and the second transmission strips can respectively folded along the first end folding lines toward a same direction, and folding portions of both strips at least partially overlap. In comparison with the side by side arrangement, through this design, the total width of the first transmission strip and the second transmission strip can be reduced to increase the convenience of disposing the entire signal transmission module.

In another embodiment, a manufacturing method of the flexible signal transmission cable includes the following steps: disposing a plurality of transmission strips side by side, wherein each of the transmission strips has an elongated shape; connecting one end of each of the plurality of transmission strips to a first connector; and respectively folding the plurality of transmission strips along first end folding lines toward a same direction, so that folding portions of the plurality of transmission strips at least partially overlap. Through this design, the width of the transmission strips when disposed side by side can be reduced to increase the convenience of disposing the entire signal transmission module.

DETAILED DESCRIPTION OF THE PREFERRED EMBODIMENT

The present invention provides a flexible signal transmission module which can provide connections between various systems, modules, or components for signal transmission. In a preferred embodiment, the flexible signal transmission module can be composed of flexible printing circuits. However, in other embodiments, the flexible signal transmission module can be composed of cables, wire assemblies, thin film interconnects, or other components which provide similar functions. Furthermore, the flexible signal transmission module can be applied to notebook computers, flat panel displays, mobile phones, and other various electronic products.

Figure 1:
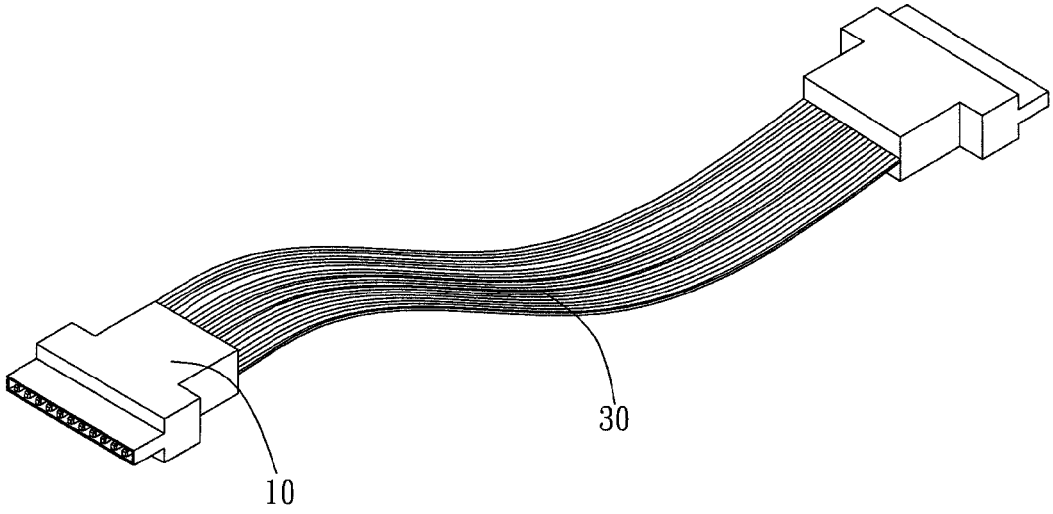
Fig. 1 ( Prior Art )
FIG. 1 is a schematic views of a conventional signal cable.
Figure 2:
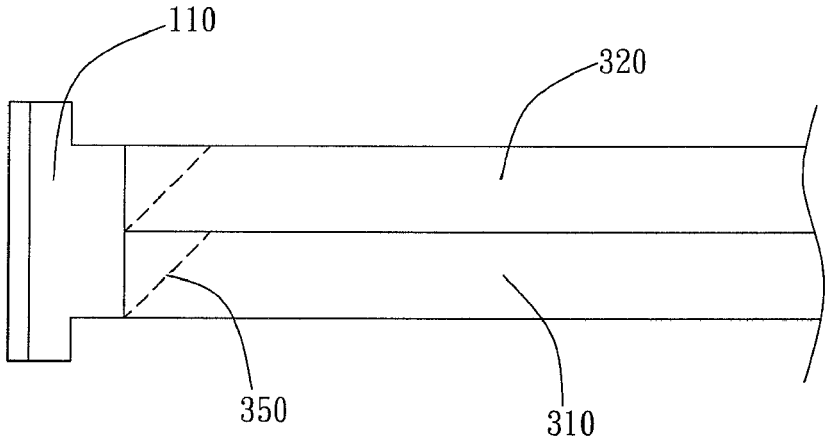
FIG. 2 is a schematic view of an embodiment of the flexible signal transmission module of the present invention.

As shown in FIG. 2, the flexible signal transmission module includes a first connector 110, a first transmission strip 310, and a second transmission strip 320. The first connector 110 is provided for connecting a circuit board or a connector on another cable, and male/female connectors can be adopted in accordance with design requirements. Moreover, the first connector 110 can be connected to the first transmission strip 310 and the second transmission strip 320 by clipping, plugging, welding or other methods. In the embodiment shown in FIG. 2, the connecting direction, i.e. the plugging direction of the first connector 110 is parallel to the first transmission strip 310 and the second transmission strip 320. However, in the embodiment shown in FIG. 3, the connecting direction, i.e., the plugging direction of the first connector 110, is perpendicular to the lengthwise direction of the first transmission strip 310 and the second transmission strip 320.

In the preferred embodiment shown in FIG. 2, the first connector 110 is a row-shaped connector, which has a width sufficient for the first transmission strip 310 and the second transmission strip 320 to connect thereto in a side-by-side manner. As shown in FIG. 2, the first transmission strip 310 and the second transmission strip 320 both have an elongated shape. The two transmission strips are disposed side by side and respectively have an end connected to the first connector 110. In this embodiment, the first transmission strip 310 and the second transmission strip 320 are formed by cutting a flexible circuit board. The ends of the first transmission strip 310 and the second transmission strip 320 connected to the first connector 110 are not separated, hence the ends still connect to each other. However, in other embodiments, the ends of the first transmission strip 310 and the second transmission strip 320 connected to the first connector 110 can be separated by cutting, so that the first transmission strip 310 and the second transmission strip 320 can be two independent strips. Furthermore, the first transmission strip 310 and the second transmission strip 320 preferably have a same width. However, in other embodiments, the first transmission strip 310 and the second transmission strip 320 can have different widths.

In this embodiment, as shown in FIG. 2, the ends of the first transmission strip 310 and the second transmission strip 320 which connect to the first connector 110 respectively have a first end folding line 350. The first end folding line 350 is merely an imaginary baseline for the first transmission strip 310 or the second transmission strip 320 to be folded, hence a concrete line is not necessary. However, in a preferred embodiment, the first end folding line 350 is a fold respectively formed on the first transmission strip 310 and the second transmission strip 320. Besides, in other embodiments, the first end folding line 350 can be formed on the first transmission strip 310 or the second transmission strip 320 through pressurizing or other methods.

Figure 3:
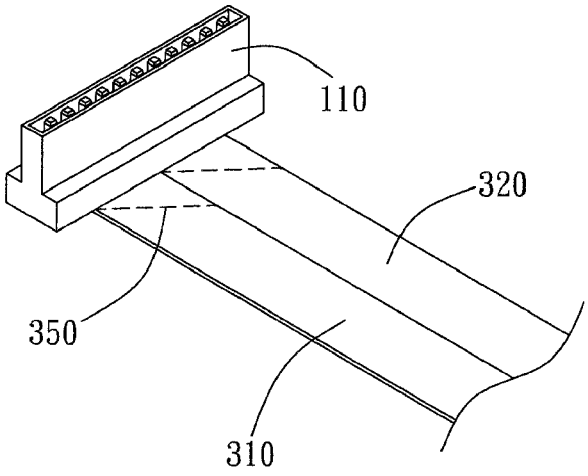
FIG. 3 is a schematic view of another embodiment of the flexible signal transmission module.

The first end folding lines 350 on the first transmission strip 310 and the second transmission strip 320 are parallel to each other and each forms an angle with respect to the edge of the first connector 110. As shown in FIG. 2 and FIG. 3, the first end folding line 350 has an angle of 45 degrees with respect to the edge of the first connector 110. In other words, when the first transmission strip 310 and the second transmission strip 320 are respectively folded along the first end folding lines 350, the first transmission strip 310 and the second transmission strip 320 are parallel to the edge of the first connector 110 after being folded. Moreover, one end of the first end folding line 350 is preferably extends from a point where one side of the first transmission strip 310 and the second transmission strip 320 and the edge of the first connector 110 intersect through first transmission strip 310 or the second transmission strip 320 obliquely to the other side.

Figure 4:
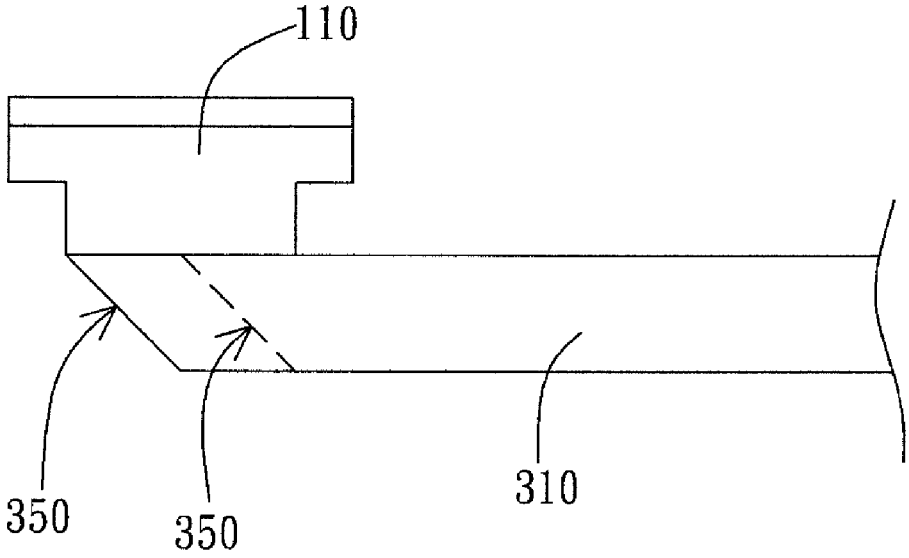
FIG. 4 is a schematic view of the embodiment shown in FIG. 2 after being folded.

As shown in FIG. 4, the first transmission strip 310 and the second transmission strip 320 can be respectively folded along the first end folding lines 350 toward a same direction. After being folded, the first transmission strip 310 and the second transmission strip 320 are preferably parallel to the unfolded portions connected to the first connector 110 respectively. The term "parallel" mentioned above means a parallel relationship between two planes rather than a parallel relationship of extending directions. However, in other embodiments, the first transmission strip 310 and the second transmission strip 320 can be inexactly folded, hence an angle can be formed between the folding portion and the unfolded portion. Moreover, the folding portions of the first transmission strip 310 and the second transmission strip 320 at least partially overlap the unfolded portion. In this embodiment, the folding portions of the first transmission strip 310 and the second transmission strip 320 totally overlap the unfolded portions. However, in other embodiments, a part of the unfolded portions can be exposed outside the folding portions.

As shown in FIG. 4, a folding portion of the first transmission strip 310 and a folding portion of the second transmission strip 320 at least partially overlap. In this embodiment, because the first transmission strip 310 is folded toward the second transmission strip 320, the first transmission strip 310 covers the second transmission strip 320 after being folded, and the first transmission strip 310 and the second transmission strip 320 extend in a same direction in a folding manner. Through this design, the total width of the first transmission strip 310 and the second transmission strip 320 is a half of the original width when disposed side by side to increase the convenience of arranging the entire signal transmission module in a system.

Figure 5A:
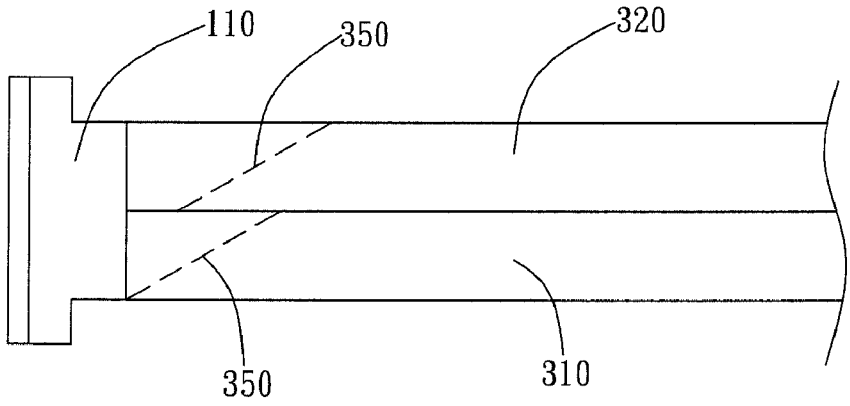
FIG. 5A is a schematic view of another embodiment of the first end folding line.
Figure 5B:
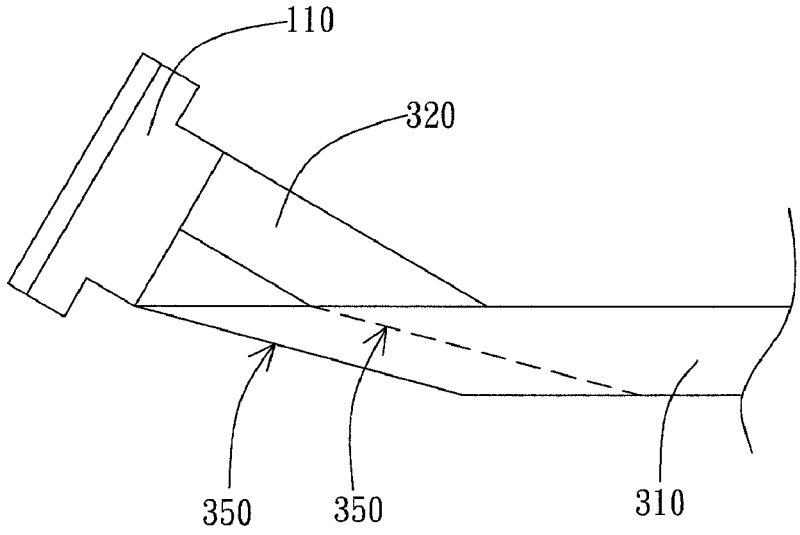
FIG. 5B is a schematic view of the embodiment shown in FIG. 5A after being folded.

Another embodiment of the present invention is shown in FIG. 5A and FIG. 5B. In this embodiment, an angle not equal to 45 degrees is formed between the first end folding line 350 and the edge of the first connector 110. In other words, when the first transmission strip 310 and the second transmission strip 320 are respectively folded along the first end folding lines 350, the first transmission strip 310 and the second transmission strip 320 are not parallel to the edge of the first connector 110 after being folded. In order to remain the overlapping of the first transmission strip 310 and the second transmission strip 320 after folding, the relative positions of the first end folding lines 350 on the first transmission strip 310 and the second transmission strip 320 need to be adjusted. As shown in FIG. 5A, the first end folding line 350 on the first transmission strip 310 is close to the first connector 110 while the first end folding line 350 on the second transmission strip 320 is distant from the first connector 110. However, in this embodiment, the first end folding lines 350 on the first transmission strip 310 and the second transmission strip 320 keep a parallel relationship with respect to each other. As shown in FIG. 5B, after being folded, the first transmission strip 310 and the second transmission strip 320 overlap to form an angle with respect to the edge of the first connector 110 instead of being parallel to the first connector 110.

Figure 6A:
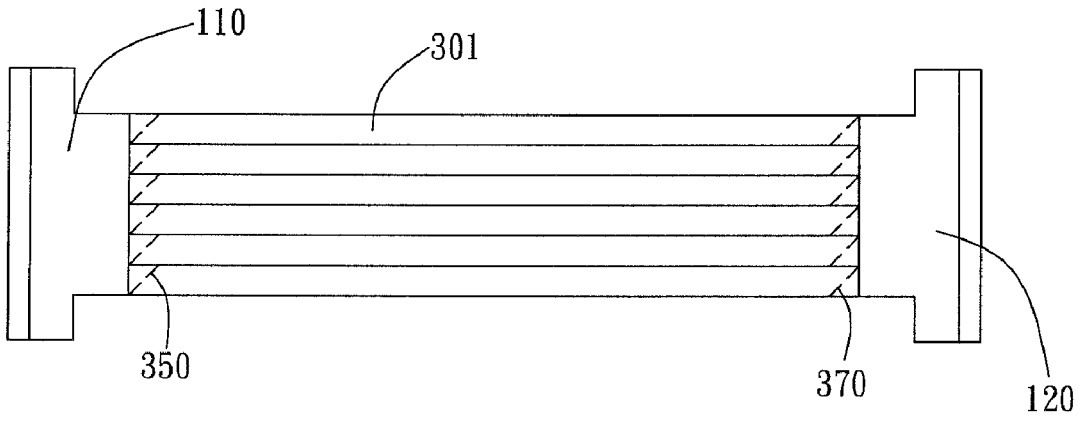
FIG. 6A is a schematic view of an embodiment of a flexible signal transmission module having a plurality of signal transmission strips.
Figure 6B:
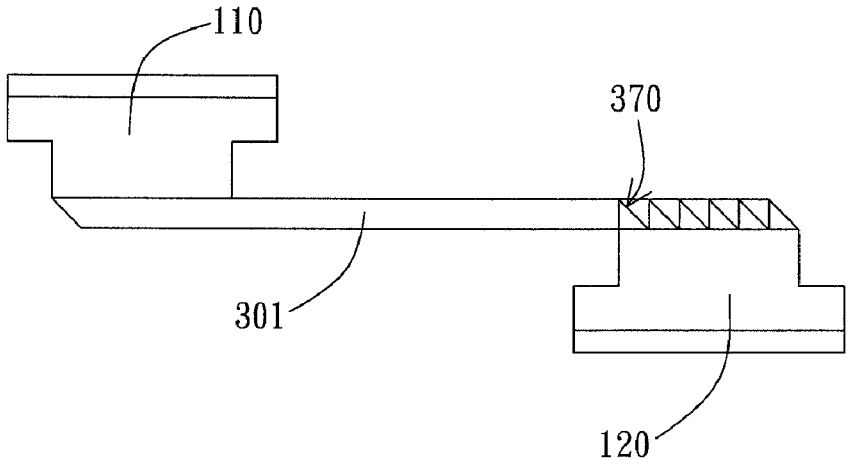
FIG. 6B is a schematic view of the embodiment shown in FIG. 6A after being folded.

In the embodiment shown in FIG. 6A, the flexible signal transmission module of the present invention includes a plurality of transmission strips 301 connected to the first connector 110 side by side. The plurality of transmission strips 301 are disposed in parallel to each other and respectively have an elongated shape. In this preferred embodiment, each of the transmission strips 301 has a same width; however, in other embodiments, each of the transmission strips 301 can have different widths. Similar to the embodiment mentioned above, the first end folding lines 350 are disposed on each of the transmission strips 301, and the first end folding lines 350 are parallel to each other. Each of the transmission strips 301 respectively folded along the first end folding line 350 toward a same direction so that folding portions are overlapped and unfolded portions are parallel to each other and folding portions of the transmission strips 301 at least partially overlap. As shown in FIG. 6B, the outer one of the transmission strips 301 covers the adjacent one in the folding direction, and then the covered one in turn overlaps the adjacent one next to it in the folding direction. Through this design, the transmission strips 301 can overlap with each other instead of being parallel to each other as originally designed, and then the original width is reduced after being folded.

Furthermore, in the embodiment shown in FIG. 6A and FIG. 6B, the flexible signal transmission cable further includes a second connector 120. The second connector 120 is disposed on the other end of the transmission strips 301 opposite to the first connector 110. The transmission strips 301 are parallel to each other and connect to the second connector 120. The end of each transmission strips 301 connected to the second connector 120 has a second end folding line 370. The second end folding line 370 forms an angle of 45 degrees or any suitable angle with respect to the edge of the second connector 120. In this embodiment, the second end folding lines 370 are parallel to the first end folding lines 350, so that the folding angle at two ends of the transmission strips 301 are the same. Meanwhile, after being folded, the first connector 110 and the second connector 120 twist by a same angle in opposite directions to respectively face opposite directions. However, in other embodiments, the second end folding lines 370 and the first end folding lines 350 are not parallel to each other, so as to change the relative angle between the first connector 110 and the second connector 120 after folding.

As shown in FIG. 6B, each of the transmission strips 301 is folded along the second end folding line 370 toward a same direction so that folding portions are overlapped and unfolded portions are parallel to each other and folding portions of the transmission strips 301 at least partially overlap. The outer one of the transmission strips 301 are covered by the adjacent inner one. It is noted that the folding direction of the transmission strips 301 along the second end folding lines 370 is opposite to that of the transmission strips 301 along the first end folding lines 350. As shown in FIG. 6B, the transmission strips 301 are folded toward the second connector 120 along the first end folding lines 350 while they are folded toward the first connector 110 along the second end folding line 370. The original parallel transmission strips 301 become a stack of overlapping strips after being folded, and a dislocation in a front-to-rear direction will occur. For example, after being folded, one end of the top layer of the transmission strips 301 protrudes out the transmission strips 301 thereunder while the other end pulls back into the edge of the transmission strips 301 thereunder.

Figure 6C:
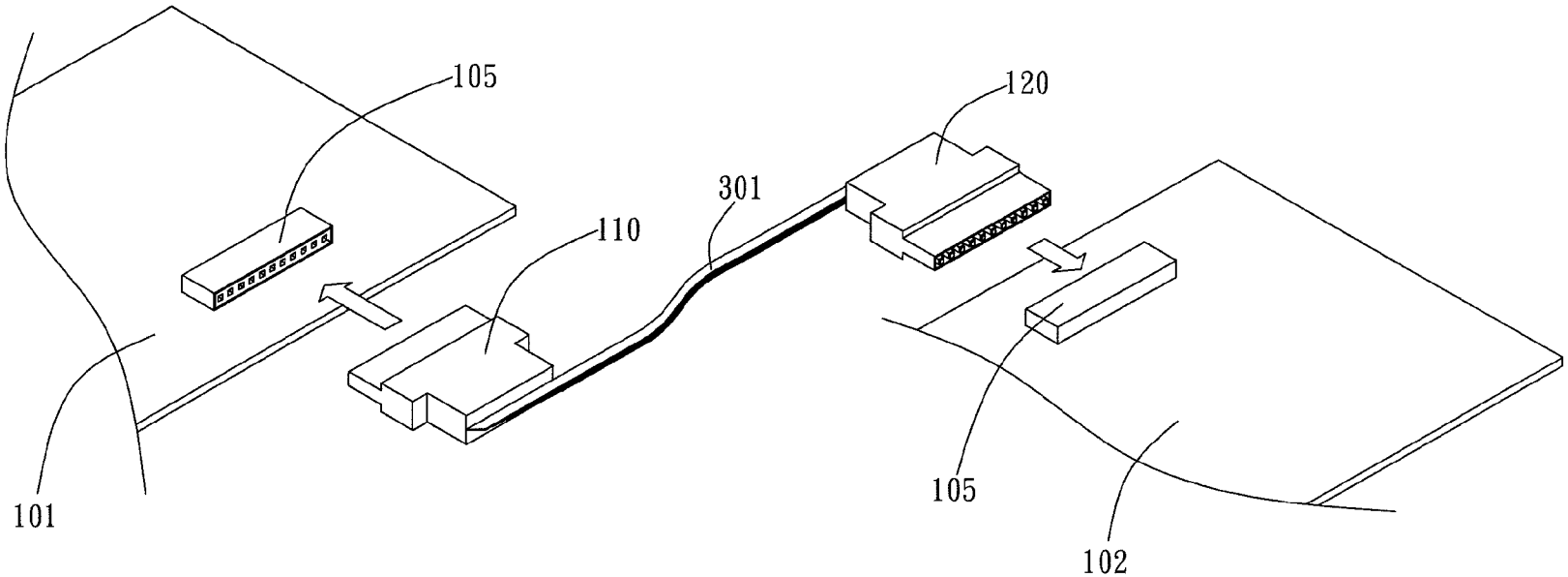
FIG. 6C is a schematic view of the embodiment shown in FIG. 6B employed in a system.

The second connector 120 is provided for connecting a circuit board or a connector on another cable, and male/female connectors can be adopted in accordance with design requirements. Moreover, the second connector 120 can be connected to the transmission strips 301 and the second transmission strip 320 by clipping, plugging, welding or other methods. In the embodiment shown in FIG. 6A and FIG. 6B, the connecting direction, i.e. the plugging direction of the second connector 120, is parallel to the lengthwise direction of the transmission strips 301 and opposite to the connecting direction of the first connector 110. FIG. 6C is the embodiment of the flexible signal transmission cable as shown in FIG. 6B applied to a system. As shown in FIG. 6C, the system includes a first circuit board 101 and a second circuit board 102 which respectively have a connector 105 thereon. The first connector 110 and the second connector 120 respectively connect to the connectors 105 of the first circuit board 101 and the second circuit board 102, so as to provide signal transmission between the first circuit board 101 and the second circuit board 102.

Figure 7A:
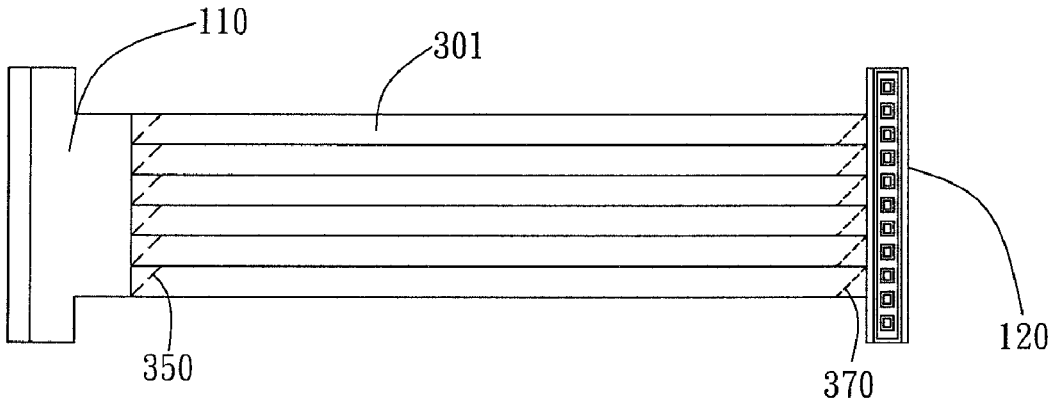
FIG. 7A is a schematic view of an embodiment of a flexible signal transmission module adopting a second connector of another design.
Figure 7B:
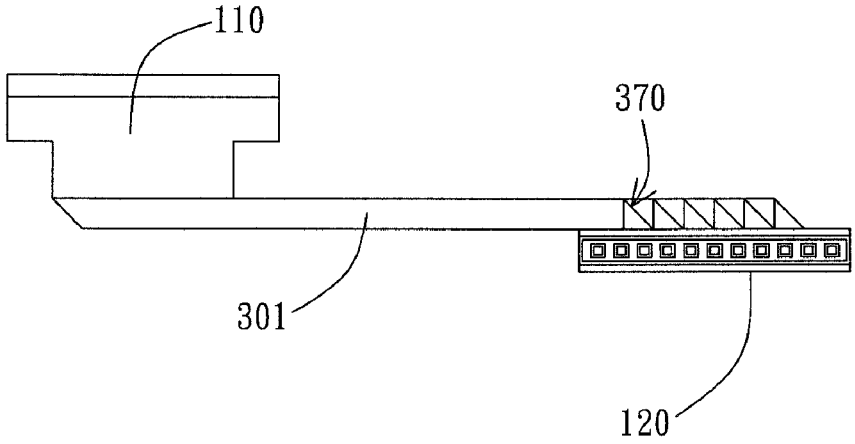
FIG. 7B is a schematic view of the embodiment shown in FIG. 7A after being folded.
Figure 7C:
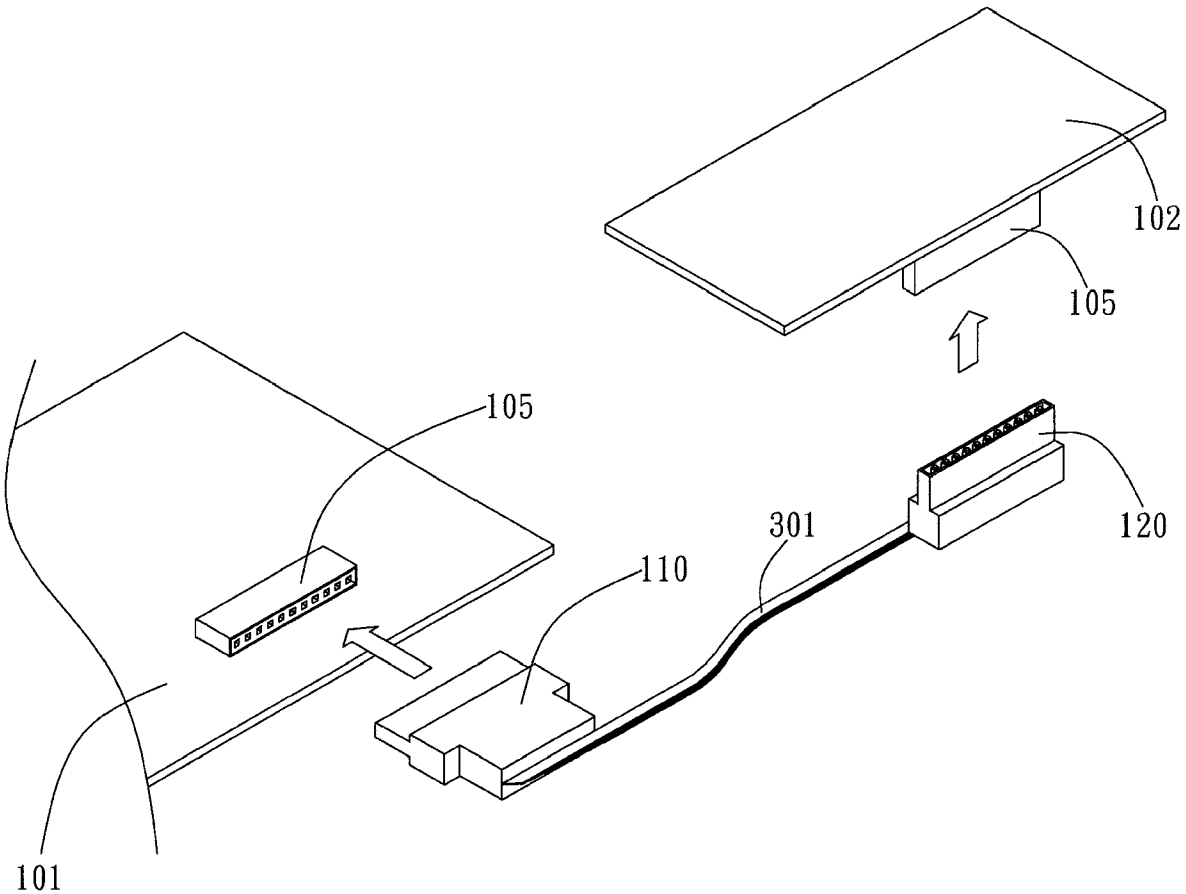
FIG. 7C is a schematic view of the embodiment shown in FIG. 7B employed in a system.

In the embodiment shown in FIG. 7A and FIG. 7B, the connecting direction, i.e. the plugging direction of the second connector 120 is perpendicular to the lengthwise direction of the first transmission strip 310 and the connecting direction of the first connector 110. Through this design, the flexible signal transmission cable can meet different connecting angle requirements. FIG. 7C is an embodiment of the flexible signal transmission cable shown in FIG. 7B applied to a system. The difference between the embodiment of FIG. 7C and the embodiment of FIG. 6C is the connecting direction of the connector 105 on the second circuit board 102. Hence, with the employment of the second connector 120 of a different connecting direction, more design options can be provided, and the space requirement of the whole system can be reduced.

Figure 8:
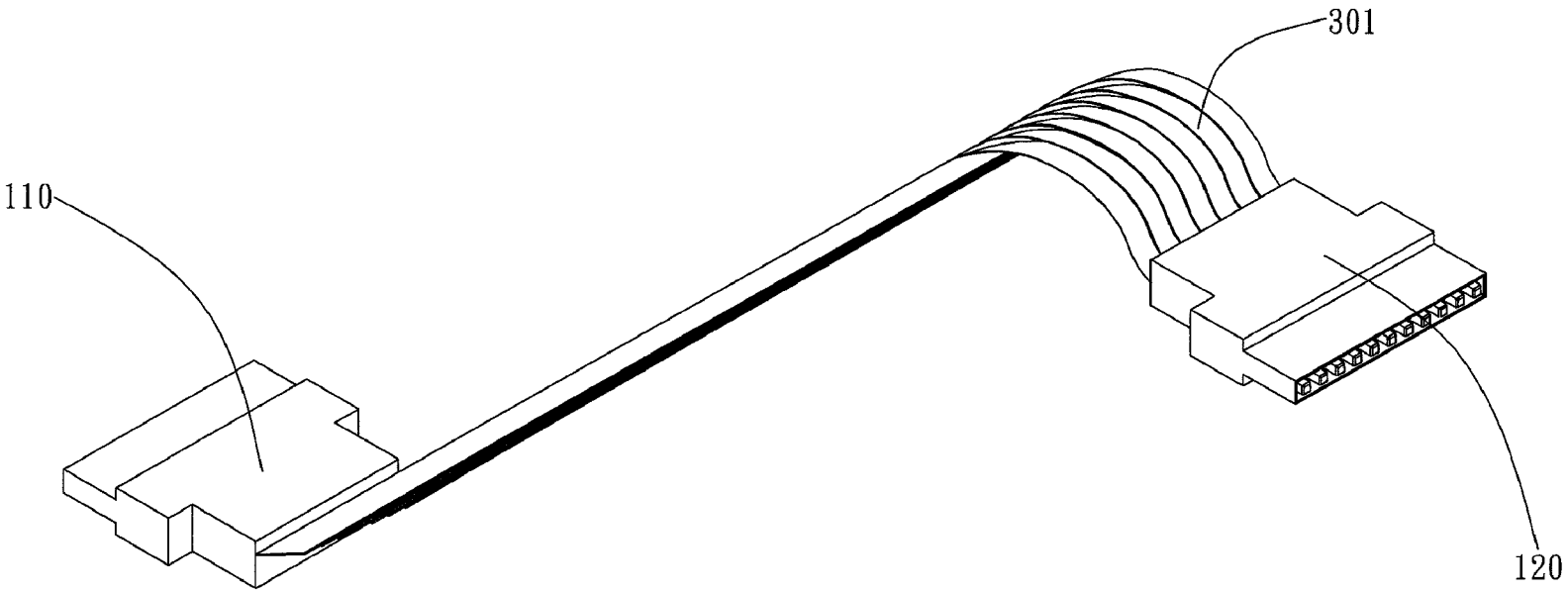
FIG. 8 is a schematic view of another embodiment of the flexible signal transmission module.

In the embodiment shown in FIG. 8, the ends of the transmission strips 301 connected to the second connector 120 do not have a second end folding line 370 and are not folded corresponding to the second connector 120. When the ends of the transmission strips 301 connected to the first connector 110 are folded and overlap with each other, because the ends of the transmission strips 301 connected to the first connector 110 after folding are dislocated while no corresponding dislocation occurs at the ends connected to the second connector 120, a twist occurs in two corresponding ends of the transmission strips 301 so that the second connector 120 simultaneously twists corresponding to the first connector 110. As shown in FIG. 8, the second connector 120 is twisted perpendicular to the first connector 110. Through this design, the flexible signal transmission cable can satisfy more different connecting angle requirements.

Figure 9A:
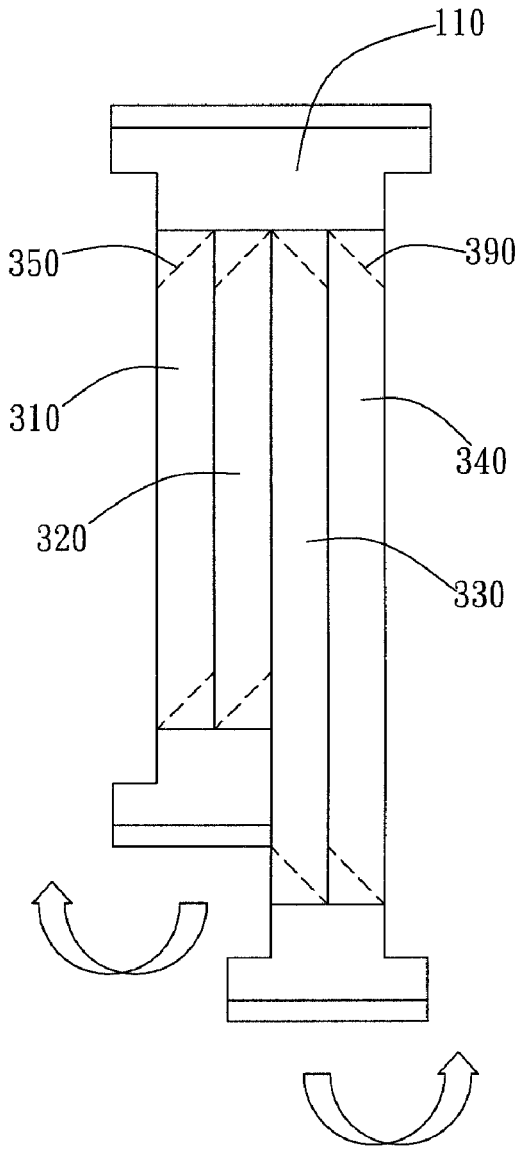
FIG. 9A is a schematic view of an embodiment of an embodiment of a flexible signal transmission module having inverse transmission strips.

In the embodiment shown in FIG. 9A, the flexible signal transmission cable further includes a third transmission strip 330 and a fourth transmission strip 340 which are connected to the first connector 110. The third transmission strip 330 and the fourth transmission strip 340 which respectively have an elongated shape are disposed parallel to the first transmission strip 310 and the second transmission strip 320, and are sequentially connected to the first connector 110. As shown in FIG. 9A, the third transmission strip 330 and the second transmission strip 320 are disposed side by side while the fourth transmission strip 340 and the third transmission strip 330 are disposed side by side in the other side of the third transmission strip 330. The ends of the third transmission strip 330 and the fourth transmission strip 340 connected to the first connector 110 respectively have an inverse folding line 390. The inverse folding lines 390 are parallel to each other. The inverse folding line 390 is merely an imaginary baseline for the third transmission strip 330 or the fourth transmission strip 340 to be folded, hence a concrete line is not necessary. However, in a preferred embodiment, the inverse folding line 390 is a fold. Furthermore, in other embodiments, the inverse folding line 390 can be formed on the third transmission strip 330 and the fourth transmission strip 340 by pressurizing or other methods.

The inverse folding line 390 form an angle with respect to the edge of the first connector 110 and is disposed in a direction corresponding to the first end folding line 350 with respect to the edge of the first connector 110. As shown in FIG. 9A, when the disposing direction of the first end folding line 350 is from bottom left to upper right, the disposing direction of the inverse folding line 390 is from upper left to bottom right, and vice versa. Furthermore, in this embodiment, the first end folding line 350 and the inverse folding line 390 have a relative relationship as if an object and its image in a mirror, hence the angles formed between both of them and the edge of the first connector 110 are the same while the mere difference is their folding direction. However, in other embodiments, the first end folding line 350 and the inverse folding line 390 can have different angles with respect to the edge of the first connector 110.

Figure 9B:
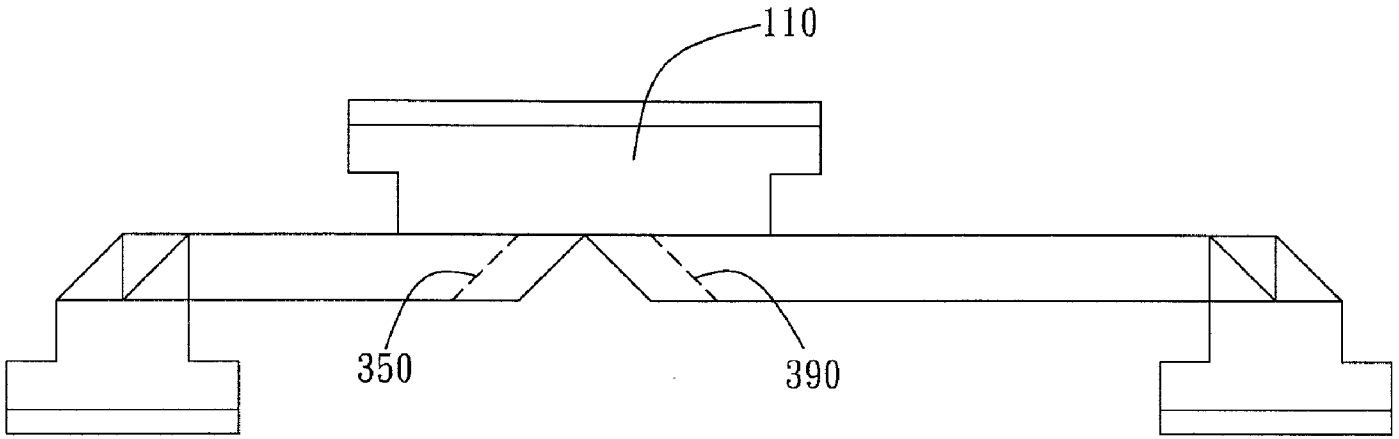
FIG. 9B is a schematic view of the embodiment shown in FIG. 9A after being folded.

As shown in FIG. 9B, similar to the first transmission strip 310 and the second transmission strip 320, the third transmission strip 330 and the fourth transmission strip 340 are respectively folded along the inverse folding line 390, and the relationship between them after being folded is also similar to the relationship between the first transmission strip 310 and the second transmission strip 320. That is, folding portions of the third transmission strip 330 and the fourth transmission strip 340 at least partially overlap. However, the first end folding line 350 and the inverse folding line 390 are disposed in corresponding directions so that the folding direction are opposite. Therefore, the group composed of the first transmission strip 310 and the second transmission strip 320 and the group composed of the third transmission strip 330 and the fourth transmission strip 340 have different folding directions. In other embodiments, the first transmission strip 310 and the second transmission strip 320 can be expanded to form a group composed of more transmission strips while the third transmission strip 330 and the fourth transmission strip 340 can also be expanded to form a group composed of more inverse transmission strips. Moreover, through adjusting the difference between the angles of the first end folding line 350 and the inverse folding line 390, the relative angle between the groups after being folded can be changed. Through this design, the groups of the first transmission strips which have different folding directions are correspondingly connected to different signal sources respectively, so as to increase the design flexibility.

Figure 10:
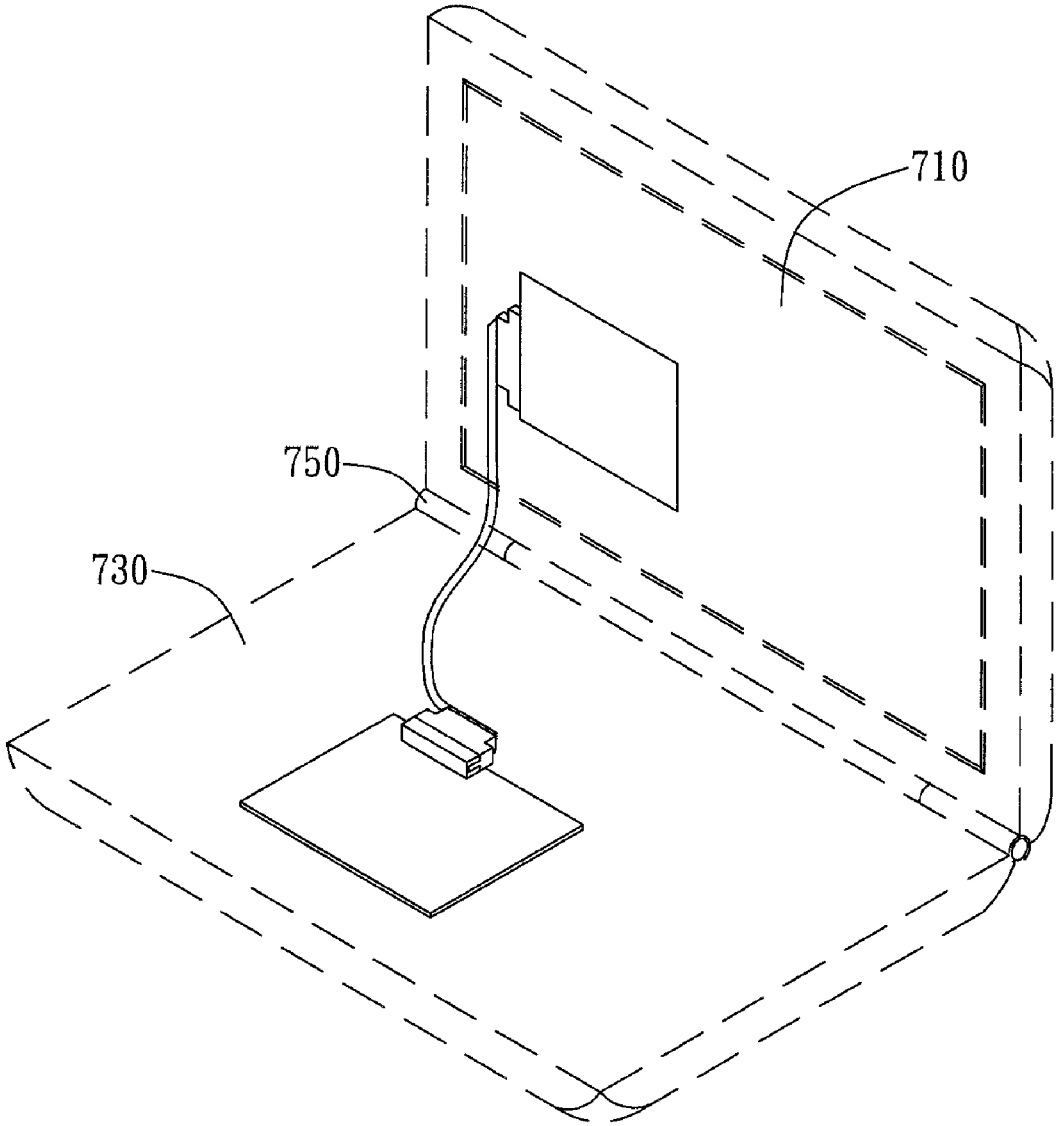
FIG. 10 is a schematic view of an embodiment of an application of the flexible signal transmission module.

As shown in FIG. 10, when the flexible signal transmission cable is disposed in an electronic device, because the transmission strips 301 are arranged in a stack manner, the lateral width is reduced, and then it become easier to twist the transmission strips 301 radially. Furthermore, taking the notebook computer as shown in FIG. 10 as an example, when the flexible signal transmission strips intend to get through smaller spaces such as the joint bearing 750 between a monitor 710 and a body 730, due to the reduced width of the overlapping transmission strips 301, the overlapping transmission strips 301 are easier to get through such smaller spaces.

Figure 11:
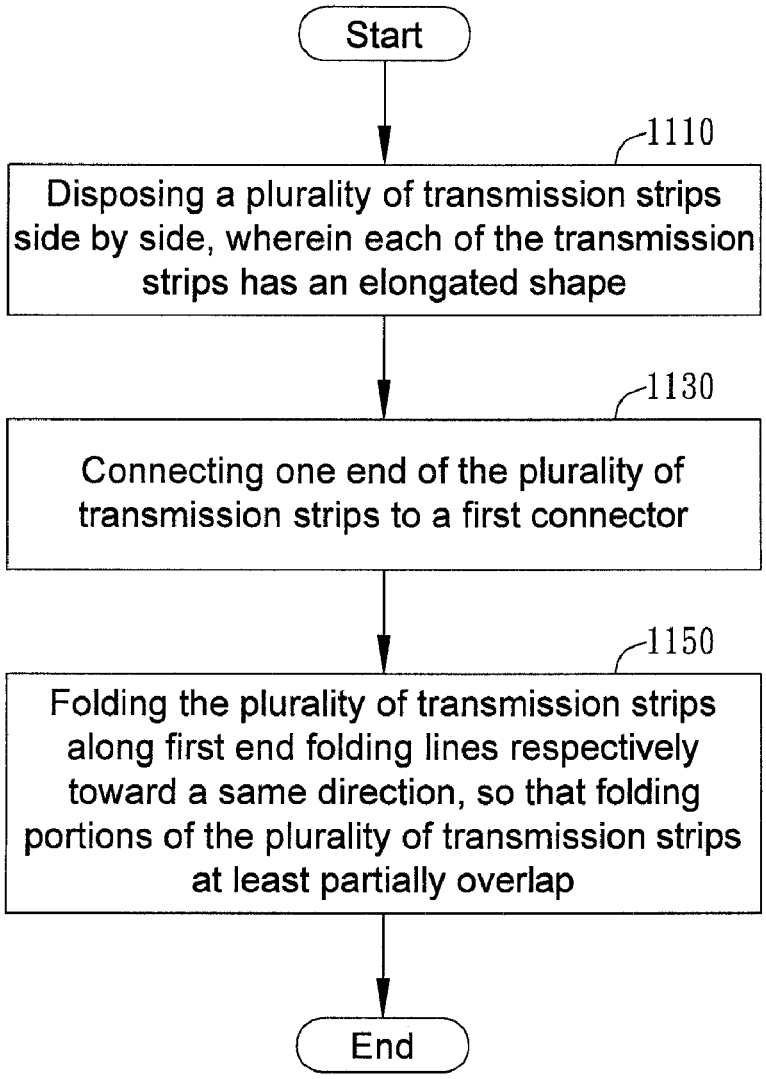
FIG. 11 is a flow chart of an exemplary method of manufacturing a flexible signal transmission module.

FIG. 11 is a flow chart of an exemplary method of manufacturing a flexible signal transmission module of the present invention. As shown in FIG. 11, Step 1110 includes disposing a plurality of transmission strips side by side, wherein each of the transmission strips has an elongated shape. In a preferred embodiment, the plurality of transmission strips having an elongated shape can be formed by cutting a transmission slice in a same direction to form a plurality of transmission strips having an elongated shape which are parallel to each other. The transmission slice is preferably composed of flexible printing circuits. However, in other embodiments, the transmission slice can be composed of cables, wire assemblies, thin film interconnects, or other components which provide similar functions.

Step 1130 includes connecting one end of the above-mentioned plurality of transmission strips to a first connector. The first connector can be connected to the plurality of transmission strips by clipping, plugging, welding or other methods. Furthermore, there is no absolute sequence to perform Step 1130 and Step 1110 in the manufacturing process. For example, connecting the transmission slice to the first connector at first, and then cutting the transmission slice to form the plurality of transmission strips having an elongated shape is allowed.

Step 1150 includes folding the plurality of transmission strips along a first end folding line respectively toward the same direction, so that folding portions of the plurality of transmission strips at least partially overlap. The first end folding line is formed on the end of each of the transmission strips connected to the first connector. The first end folding lines are parallel to each other and each forms an angle with respect to the edge of the first connector. The first end folding line is merely an imaginary baseline for the transmission strips to be folded, hence a concrete line is not necessary. However, in a preferred embodiment, the method further includes forming a fold on each of the transmission strips. The fold serves as the first end folding line. Besides, in other embodiments, the first end folding lines can be formed on transmission strips through pressurizing or other methods.

In a preferred embodiment, the first end folding line has an angle of 45 degrees with respect to the edge of the first connector, hence the folding portion will be parallel to the edge of the first connector after the transmission strips are folded. However, in other embodiments, the angle between the first end folding line and the edge of the first connector can be adjusted, so that folding portions of the transmission strips form different angles with respect to the edge of the first connector.

Figure 12:
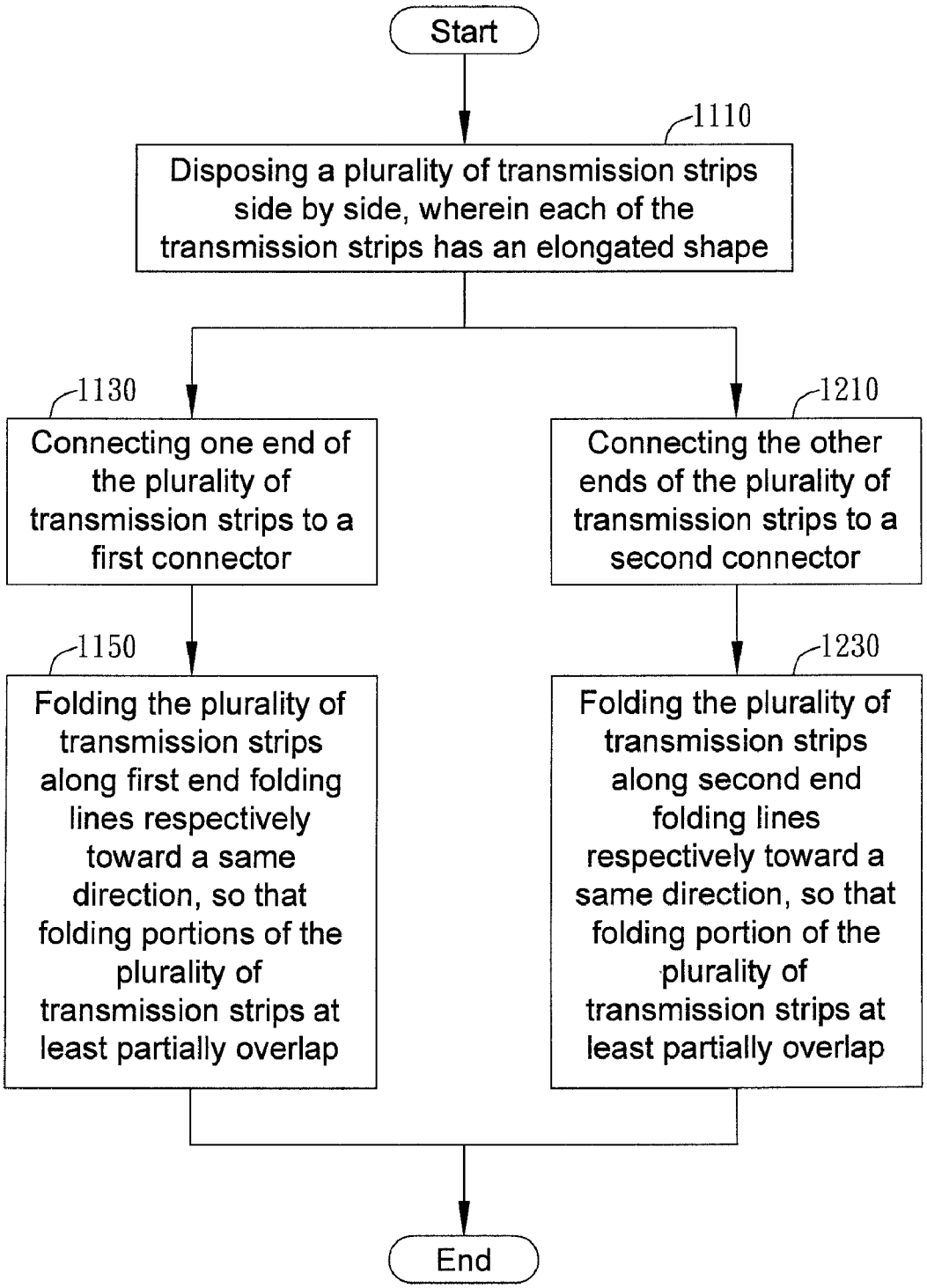
FIG. 12 is a flow chart of another exemplary method of manufacturing a flexible signal transmission module.

In another embodiment, as shown in FIG. 12, the method further includes Step 1210. Step 1210 includes connecting the other ends of the plurality of transmission strips to a second connector. Step 1230 includes folding the plurality of transmission strips along second end folding lines respectively toward a same direction, so that folding portions of the plurality of transmission strips at least partially overlap. The second end folding lines are on the ends of the transmission strips connected to the second connector. The second end folding lines are parallel to each other and have an angle with respect to the edge of the second connector. In a preferred embodiment, the second end folding lines are parallel to the first end folding lines while the folding direction of the first end folding lines and the second end folding lines are opposite.

Figure 13:
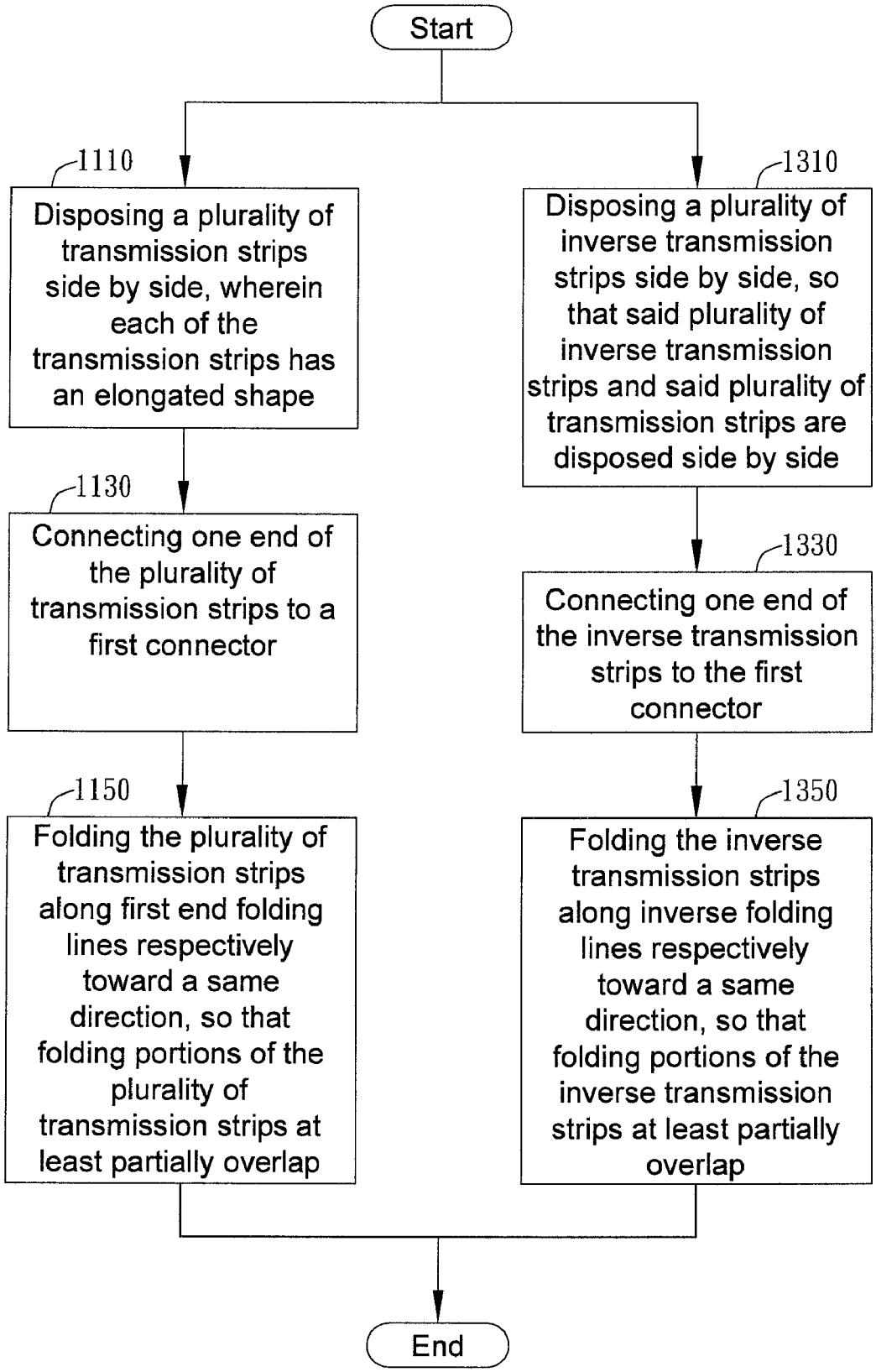
FIG. 13 is a flow chart of yet another exemplary method of manufacturing a flexible signal transmission module.

In another embodiment, as shown in FIG. 13, the method further includes Step 1310. Step 1310 includes disposing a plurality of inverse transmission strips side by side, so that the plurality of inverse transmission strips and the plurality of transmission strips are disposed side by side. Step 1330 includes connecting one end of the inverse transmission strips to the first connector. The formation and the disposition of the inverse transmission strips are similar to those of the transmission strips and are preferably formed by cutting a transmission slice.

Step 1350 includes folding the inverse transmission strips along inverse folding lines respectively toward a same direction, so that folding portions of the inverse transmission strips at least partially overlap. The formation and the disposition of the inverse folding line are similar to those of the first end folding line mentioned above while their folding directions are opposite to each other with respect to the edge of the first connector. As to a preferred embodiment, after the transmission strips and the inverse transmission strips are respectively folded along the first end folding line and the inverse folding line, the transmission strips and the inverse transmission strips will extend toward different directions distant from each other.

Although the present invention has been described through the above-mentioned related embodiments, the above-mentioned embodiments are merely the examples for practicing the present invention. What need to be indicated is that the disclosed embodiments are not intended to limit the scope of the present invention. On the contrary, the modifications within the essence and the scope of the claims and their equivalent dispositions are all contained in the scope of the present invention.

What is claimed is:

1. A flexible signal transmission module, comprising:

a first connector;

a first transmission strip having an elongated shape and including an end connected to said first connector; and a second transmission strip having an elongated shape and including an end connected to said first connector, wherein said second transmission strip and said first transmission strip are disposed side by side;

wherein the ends of said first transmission strip and said second transmission strip connected to said first connector respectively have a first end folding line, said first end folding lines are parallel to each other and each forms an angle with respect to an edge of said first connector, said first transmission strip and said second transmission strip are respectively folded along said first end folding lines toward a same direction, and a folding portion of said first transmission strip and a folding portion of said second transmission strip at least partially overlap, said first end folding line has an angle of 45 degrees with respect to the edge of said first connector, and the folding portions of said first transmission strip and said second transmission strip are parallel to the edge of said first connector.

2. The flexible signal transmission module of claim 1, further comprising a second connector disposed opposite to said first connector, wherein the other ends of said first transmission strip and said second transmission strip are respectively connected to said second connector.

3. The flexible signal transmission module of claim 2, wherein the other ends of said first transmission strip and said second transmission strip connected to said second connector respectively have a second end folding line, said second end folding lines are parallel to each other and each forms an angle with respect to an edge of said second connector, said first transmission strip and said second transmission strip are respectively folded along said second end folding lines toward a same direction opposite to the folding direction of said first transmission strip and said second transmission strip along said first end folding line.

4. The flexible signal transmission module of claim 3, wherein said first end folding line and said second end folding line are parallel to each other.

5. The flexible signal transmission module of claim 2, wherein the other ends of said first transmission strip and said second transmission strip connected to said second connector are disposed side by side and said second connector twists by an angle with respect to said first connector.

6. The flexible signal transmission module of claim 1, further comprising:

a third transmission strip having an elongated shape and including an end connected to said first connector, wherein said third transmission strip and said second transmission strip are disposed side by side; and a fourth transmission strip having an elongated shape and including an end connected to said first connector, wherein said fourth transmission strip and said third transmission strip are disposed side by side;

wherein the ends of said third transmission strip and said fourth transmission strip connected to said first connector respectively have an inverse folding line, said inverse folding lines are parallel to each other and each forms an angle with respect to the edge of said first connector, said inverse folding lines and said first end folding lines are disposed in corresponding directions with respect to the edge of said first connector, said third transmission strip and said fourth transmission strip are respectively folded along said inverse folding lines toward a same direction, and folding portions of said third transmission strip and said fourth transmission strip at least partially overlap.

7. A flexible signal transmission cable, comprising:

a first connector; and a plurality of transmission strips disposed side by side, each of said transmission strips having an elongated shape and including an end connected to said first connector;

wherein the ends of said plurality of transmission strips connected to said first connector respectively have a first end folding line, said first end folding lines are parallel to each other and each forms an angle with respect to an edge of said first connector, said plurality of transmission strips are respectively folded along said first end folding lines toward a same direction so that folding portions of said plurality of transmission strips at least partially overlap, said first end folding line has an angle of 45 degrees with respect to said edge of said first connector, and the folding portions of said plurality of transmission strips are parallel to the edge of said first connector.

8. The flexible signal transmission cable of claim 7, further comprising a second connector disposed opposite to said first connector, wherein the other ends of said plurality of transmission strips are respectively connected to said second connector.

9. The flexible signal transmission cable of claim 8, wherein the other ends of said plurality of transmission strips connected to said second connector respectively have a second folding line, said second end folding lines are parallel to each other and each forms an angle with respect to an edge of said second connector, said plurality of transmission strips are respectively folded along said second end folding lines toward a same direction so that folding portions are overlapped and unfolded portions are parallel to each other, the folding directions of said plurality of transmission strips along said first end folding line and along said second end folding line are opposite to each other.

10. The flexible signal transmission cable of claim 9, wherein said first end folding line and said second end folding line are parallel to each other.

11. The flexible signal transmission cable of claim 8, wherein the other ends of said plurality of transmission strips connected to said second connector are disposed side by side and said second connector twists by an angle with respect to said first connector.

12. The flexible signal transmission cable of claim 7, further comprising:

a plurality of inverse transmission strips disposed side by side, each of said inverse transmission strips having an elongated shape and including an end connected to said first connector, wherein said plurality of inverse transmission strips and said plurality of transmission strips are disposed side by side;

wherein the ends of said plurality of inverse transmission strips connected to said first connector respectively have an inverse folding line, said inverse folding lines are parallel to each other and each forms an angle with respect to the edge of said first connector, said inverse folding lines and said first end folding lines are disposed in corresponding directions with respect to the edge of said first connector, said plurality of inverse transmission strips are respectively folded along said inverse folding lines toward a same direction so that folding portions are parallel to unfolded portions, and folding portions of said plurality of inverse transmission strips at least partially overlap.

13. A method for manufacturing a flexible signal transmission cable, comprising:

disposing a plurality of transmission strips side by side, wherein each of said transmission strips has an elongated shape;

connecting one end of each of said plurality of transmission strips to a first connector; and folding said plurality of transmission strips along a first end folding line respectively toward a same direction, so that folding portions of said plurality of transmission strips at least partially overlap, wherein said first end folding lines are respectively located at the end of each of said plurality of transmission strips connected to said first connector, said first end folding lines are parallel to each other and each forms an angle with respect to the edge of said first connector, the step of folding comprises folding said plurality of transmission strips along said first end folding lines having an angle of 45 degrees with respect to the edge of said first connector toward the same direction, so that folding portions of said plurality of transmission strips are parallel to the edge of said first connector.

14. The method of claim 13, wherein the step of disposing said plurality of transmission strips comprises cutting a transmission slice in a same direction to form said plurality of transmission strips having the elongated shape.

15. The method of claim 13, further comprising respectively connecting the other end of each of said plurality of transmission strips to a second connector.

16. The method of claim 15, further comprising folding said plurality of transmission strips along second end folding lines respectively toward a same direction, so that folding portions of said plurality of transmission strips at least partially overlap, wherein said second end folding lines are respectively located at the other end of each of said plurality of transmission strips connected to said second connector, said second end folding lines are parallel to each other and each forms an angle with respect to an edge of said second connector, the folding directions of said plurality of transmission strips along said first end folding line and along said second end folding line are opposite to each other.

17. The method of claim 13, further comprising:

disposing a plurality of inverse transmission strips side by side, so that said plurality of inverse transmission strips and said plurality of transmission strips are disposed side by side, wherein each of said inverse transmission strips has an elongated shape;

connecting one end of each of said plurality of inverse transmission strips to a first connector; and folding said plurality of inverse transmission strips along inverse folding lines respectively toward a same direction, so that folding portions of said plurality of inverse transmission strips at least partially overlap, wherein said inverse folding lines are located at an end of said plurality of inverse transmission strips connected to said first connector and each forms an angle with respect to the edge of said first connector, said inverse folding lines and said first end folding lines are disposed in opposite directions with respect to the edge of said first connector.

* * * * *